US006268848B1

(12) United States Patent
Eglit

(10) Patent No.: US 6,268,848 B1
(45) Date of Patent: Jul. 31, 2001

(54) METHOD AND APPARATUS IMPLEMENTED IN AN AUTOMATIC SAMPLING PHASE CONTROL SYSTEM FOR DIGITAL MONITORS

(75) Inventor: Alexander Julian Eglit, Half Moon Bay, CA (US)

(73) Assignee: Genesis Microchip Corp., Alviso, CA (US)

( * ) Notice: Subject to any disclaimer, the term of this patent is extended or adjusted under 35 U.S.C. 154(b) by 0 days.

(21) Appl. No.: 09/177,897

(22) Filed: Oct. 23, 1998

(51) Int. Cl.[7] ..... G09G 5/00

(52) U.S. Cl. ..... 345/213; 345/132; 345/204; 345/3; 348/537; 348/571; 331/1

(58) Field of Search ..... 345/213, 204, 345/132, 3; 348/537, 571; 331/1

(56) References Cited

U.S. PATENT DOCUMENTS 5,541,665 * 7/1996 Urata et al. ..... 348/571
5,838,202 * 11/1998 Kosiec et al. ..... 331/1
5,945,983 * 8/1999 Kanno et al. ..... 345/204
5,990,968 * 11/1999 Naka et al. ..... 348/537
6,043,803 * 11/1998 Shimizu ..... 345/213

* cited by examiner

*Primary Examiner*—Richard Hjerpe
*Assistant Examiner*—Ali A. Zamani
(74) *Attorney, Agent, or Firm*—Law Firm of Naren Thappeta

(57) ABSTRACT

An automatic sampling control system for digital monitors. A clock generation circuit generates a sampling clock. A phase controller modifies the phase of the sampling clock by a phase amount. An ADC samples a frame of an analog display signal to generate digital samples. A value which is a function of the samples is generated. The function generally generates a larger value with correspondingly large sample values. The phase amount is modified for successive image frames until a maximum function value is generated. When successive image frames do not change substantially in image content, the phase amount represents the optimal phase change for the sampling clock. If the image content is changing substantially, the phase adjustment may be disabled.

31 Claims, 9 Drawing Sheets

METHOD AND APPARATUS IMPLEMENTED IN AN AUTOMATIC SAMPLING PHASE CONTROL SYSTEM FOR DIGITAL MONITORS

RELATED APPLICATIONS

The present application is related to the co-pending patent application entitled, "A Method and Apparatus Implemented in a Computer System for Determining the Frequency Used by a Graphics Source for Generating an Analog Display Signal", Ser. No. 08/872,774, Filed: Jun. 10, 1997, and is incorporated in its entirety herewith.

BACKGROUND OF THE INVENTION

1. Field of the Invention

This invention relates generally to computer graphics systems. More particularly, this invention relates to a method and apparatus implemented in an automatic sampling phase control system for digital monitors which adjusts the phase of an analog display signal sampling system clock depending upon numerical characteristics of the values of digital samples.

2. Related Art

A computer system may display images on a digital display. Generally, an analog display signal is received by the digital display. The digital display usually samples the analog display signal to generate discrete samples. The discrete samples can be used to determine pixel values which may be used to display images on the digital display.

FIG. 1 shows a portion of a typical computer system including a graphics source 12 and a digital display 14. The graphic source 12 generates an analog display signal and a corresponding reference signal which are provided to the digital display 14. The graphics source 12 typically generates the analog display signal by converting a stream of digital image data into an analog signal through a digital to analog converter (DAC) 16. Control circuitry 18 within the graphics source generates the reference signal which typically includes horizontal synchronization (HSYNC) and vertical synchronization (VSYNC). The analog display signal typically includes RGB (red, blue and green) signal components. Only a single line carrying the RGB signal is shown.

The digital display 14 receives the analog display signal and the reference signal. The digital display 14 includes an analog to digital converter (ADC) 20 which digitally samples the analog display signal. The digital display 12 also includes reference clock source 22 which generates a sampling signal. Ideally, the sampling signal includes a sampling frequency which is equivalent to the rate or frequency that the graphic source 12 clocks image data to the DAC 16. Typically, the reference clock source 22 is phase locked to the reference signal. The digital display 12 also includes a phase controller 24 which allows adjustment of the phase of the sampling signal. The output of the phase controller 24 is connected to the ADC 20, and the delayed sampling signal determines the points in time that the ADC 20 samples the analog image signal. Therefore, adjustment of the phase controller adjusts the points in time that the ADC 20 samples the analog image signal. The digital samples generated by the ADC 20 are also received by digital processing and display circuitry 26.

As shown in FIG. 1, the analog display signal and the reference signal are typically coupled between the graphic source 12 and the digital display 14 through separate electrical paths. Due to varying impedances and lengths of the cables, the reference signal and the analog display signal can be received by the digital display 14 at slightly varied times.

Ideally, the output (the analog image signal) of the DAC 16 resembles a stairway, and the ADC 20 samples the analog image signal at the flat areas of the stairway. Also ideally, the flat areas are of sufficient duration in time to allow for some unavoidable phase jitter of the sampling signal. If the flat area of the analog display signal is of substantially greater time duration than the phase jitter of the sampling signal, phase adjustment of the sampling signal is not critical and can normally be performed by a user of the digital display 14 via buttons which control the phase controller 24.

Traditional digital displays 14 are relatively insensitive to adjustment of the phase of the sampling signal. In many cases, the phase adjustment of the sampling signal is only required to be adjusted a single time. However, with the advent of high resolution flat panels and increasing frame rates of graphic systems, a single adjustment is generally inadequate.

A typical SXGA system includes a 75 HZ refresh rate and a 135 MHZ clock rate (7 nanosecond pixel period). Typically, the duration of the impulse response of the association digital display DAC and cables is 12 to 15 nanoseconds or more. This means that the flat area of the DAC output is missing altogether and the adjustment of the phase of the sampling signal becomes critical. Incorrect selection of the phase delay of the sampling signal diminishes the resolution of the digital display 14. Fine image features appear fuzzy and noise-like artifacts may be introduced because the sampling of the analog image signal is extremely sensitive to phase jitter of the delayed sampling signal.

FIG. 2 shows amplitude versus time response of a single pixel of an analog display signal for a high performance digital display 14. The signal is a pulse, which represents a single pixel having a high intensity, in which neighboring pixels on either side have a low intensity. The pulse is narrow, has tilted edges, and does not have a flat top. Clearly, deviations in the point in time at which the pulse of the analog image signal is sampled, introduces great variations in the magnitude of the sampled digital data.

As indicated in FIG. 2, the optimal sampling point is at the analog signal peak 210 of the pulse for a single pixel. Sampling the pulse earlier at point 212, or later at point 214 provides a digital data representation of the pixel which is lower in magnitude than the digital data representation provided when sampling at the peak.

It is desirable to have a method and apparatus of a computer digital display which provides automatic adjustment of a sampling clock which provides optimal sampling of an analog display signal.

SUMMARY OF THE INVENTION

The present invention is directed to a computer digital display which provides for optimal automatic sampling of an analog display signal. As described in further detail below, the invention takes advantage of the property of common image frames, which do not change substantially in a short duration.

Assuming first for illustration only, that successive image frames (and thus the analog signal portions for a particular pixel position) do not change in content, the sampling phase can be varied to maximize the digital sample for a pixel position. However, the assumption that the analog signal for the pixel position is not changing in successive frames may not hold true.

Accordingly, the present invention generates a value which is a function of several digital samples (corresponding to several pixel positions) of an image frame, and varies the sampling phase to maximize the value. Assuming the changes between several successive frames are minimal (or non-existent), sampling with the proper phase results in maximum value for the function. Therefore, the sampling phase is varied to maximize the function value. However, if the successive image frames are changing substantially in content, phase adjustment is inhibited or prevented.

Several approaches may be employed in accordance with the present invention for determining which pixel positions are selected and for varying the sampling phase. In a first embodiment, a first step of the method includes sampling a plurality of lines of the analog display signal at points in time determined by the delayed sampling clock. A second step includes detecting peaks and valleys of a signal representing the digital signal digital samples.

A third step includes generating a first numerical value based upon relative values of magnitudes of the peaks and valleys. A fourth step includes adjusting the delay of the sampling clock maximizing the first numerical value.

A second embodiment of the invention is similar to the first embodiment. The second embodiment further includes generating a second numerical value based on values of first pixels of lines of the display signal digital samples, and adjusting the delay of the sampling clock maximizing the second numerical value.

A third embodiment of the invention is similar to the second embodiment. The third embodiment further includes summing a weighted representation of the first numerical value and a weighted representation of the second numerical value generating a statistical value, and adjusting the delay of the sampling clock maximizing the statistical numerical value.

A fourth embodiment of the invention includes an automatic sampling control system. The automatic sampling control system includes a phase controller receiving a sampling clock. The phase controller adjustably delays the sampling clock according to a statistical controller. An ADC samples an analog display signal. The ADC samples the analog display signal at points in time determined by the delayed sampling clock. The automatic sampling control system further includes an automatic sampling phase controller. The automatic sampling phase controller includes a peak detector which detects peaks and valleys within each line of the analog display signal from the ADC samples and generates a first numerical value based on magnitudes of the peaks and valleys. The statistical controller adjusts the phase controller maximizing the first numerical value.

A fifth embodiment is similar to the fourth embodiment. The automatic sampling phase controller of the fifth embodiment further includes an edge detector which generates a second numerical value based on sampling values of first pixels of lines of the analog display signal. The statistical controller adjusts the phase controller maximizing the second numerical value.

A sixth embodiment is similar to the fifth embodiment. The automatic sampling phase controller of the sixth embodiment further includes a statistical analyzer which combines the first numerical value and the second numerical value generating a statistical value. The statistical controller adjusts the phase controller maximizing the statistical value.

A seventh embodiment of the invention includes computer monitor system. The computer monitor system includes a clock generator generating a sampling clock. A phase controller receives the sampling clock and adjustably delaying the sampling clock according to a statistical controller. An ADC samples an analog display signal generating display signal digital samples. The ADC samples the analog display signal at points in time determined by the delayed sampling clock. A display processor and panel receives the display signal digital samples. The computer monitor system further includes an automatic sampling phase controller. The automatic sampling phase controller includes a peak detector which detects peaks and valleys within each line of the analog display signal from the ADC samples and generates a first numerical value of a sum of magnitudes of the peaks and valleys. The statistical controller adjusts the phase controller maximizing the first numerical value.

An eighth embodiment is similar to the seventh embodiment. The automatic sampling phase controller of the eighth embodiment further includes an edge detector which generates a second numerical value of a sum of sampling values of first pixels of lines of the analog display signal. The statistical controller adjusts the phase controller maximizing the second numerical value.

An ninth embodiment is similar to the eighth embodiment. The automatic sampling phase controller of the ninth embodiment further includes a statistical analyzer which combines the first numerical value and the second numerical value generating a statistical value. The statistical controller adjusts the phase controller maximizing the statistical value.

Thus, the present invention enables automatic determination of the appropriate sampling phase by taking advantage of the property of display signals, which contain successive image frames not changing substantially in content.

The present invention prevents false triggering of phase adjustment by monitoring the analog display signal and detecting when successive image frames change substantially.

The present invention automatically determines the appropriate sampling phase by maximizing a value which is a function of multiple display signal digital samples.

Further features and advantages of the invention, as well as the structure and operation of various embodiments of the invention, are described in detail below with reference to the accompanying drawings. In the drawings, like reference numbers generally indicate identical, functionally similar, and/or structurally similar elements. The drawing in which an element first appears is indicated by the leftmost digit(s) in the corresponding reference number.

BRIEF DESCRIPTION OF THE DRAWINGS

The present invention will be described with reference to the accompanying drawings, wherein.

DETAILED DESCRIPTION OF THE PREFERRED EMBODIMENTS

OVERVIEW AND DISCUSSION OF THE INVENTION

Figure 1:
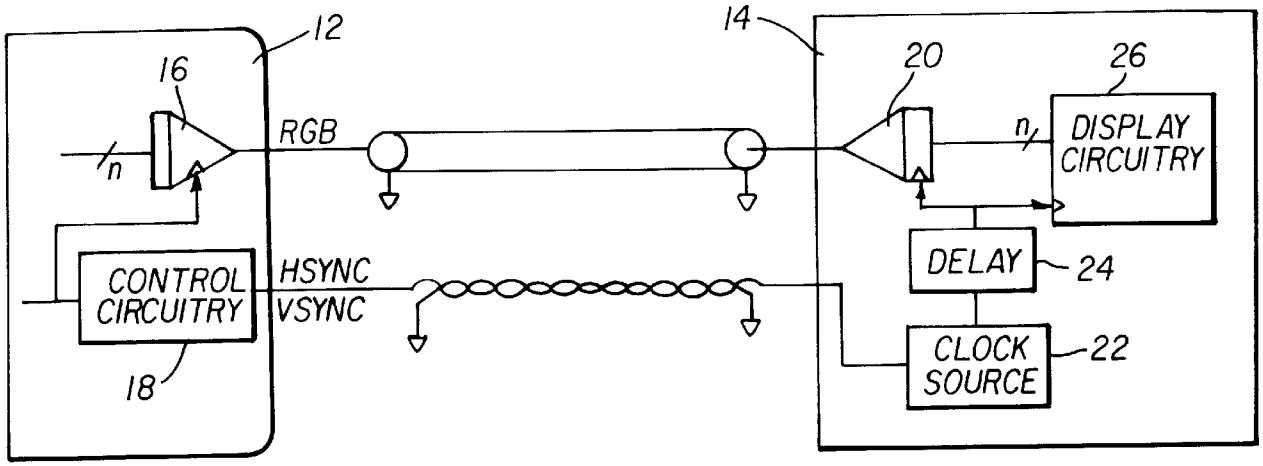
FIG. 1 shows a graphics source connected to a digital display.
Figure 2:
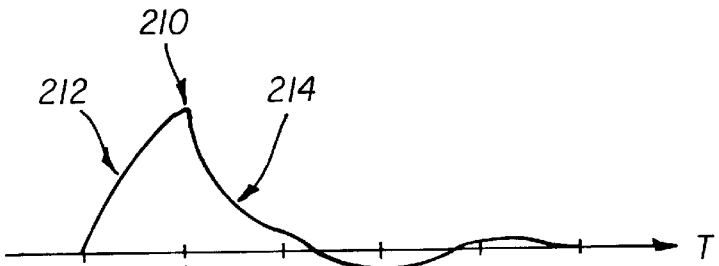
FIG. 2 shows a pulse which represents a single pixel of an analog display signal.

As shown in the drawings for purposes of illustration, the invention is embodied in a method and apparatus for an automatic sampling phase control system for digital monitors. The automatic sampling phase control system automatically adjusts the phase delay of a sampling clock within a digital display which optimizes the sampling of an analog image signal received by the digital display.

The automatic adjustment is accomplished based on the observation that successive image frames do not change substantially in image content. The sampling phase is varied and a value which is a function of multiple digital samples of an image frame is generated. The value is generated for successive image frames. Successive generally refers to consecutive image frames, but can be interspersed according to a designers choice. The sampling phase is varied to maximize the value. When a maximum value is generated, the corresponding sampling phase is determined to be the accurate sampling phase.

The digital samples used for generating the value can be selected according to several approaches. A first approach includes using peaks and valleys of a signal forming the digital samples of an image frame. A second approach includes using the values of the digital samples of first pixels of lines of the image signal.

The invention is described below in further detail with reference to several example embodiments.

EXAMPLE ENVIRONMENT

Figure 3:
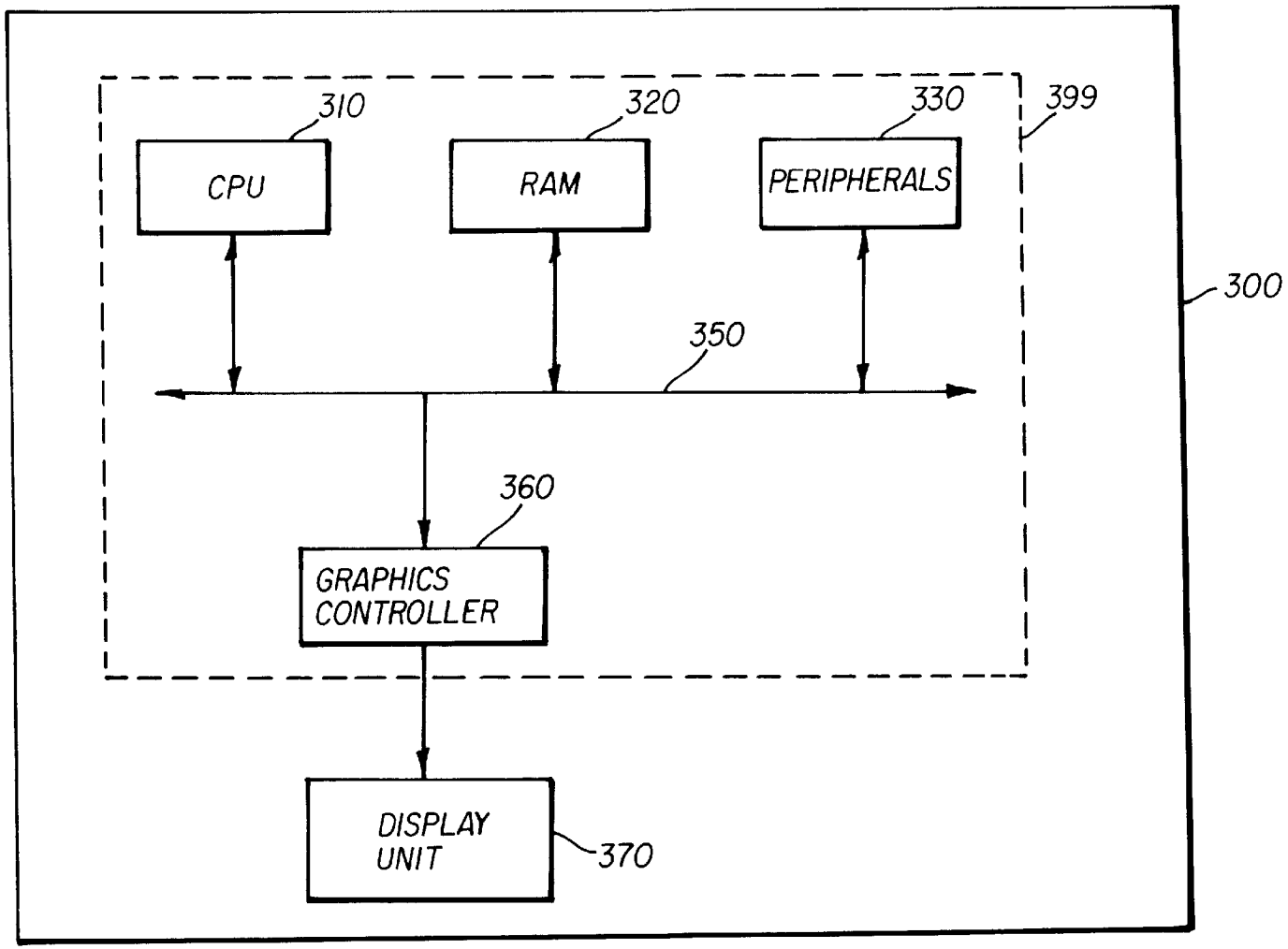
FIG. 3 is a block diagram of a computer system in which the invention can be implemented.

FIG. 3 is a block diagram of computer system 300 in which the invention can be implemented. The computer system 300 includes a central processing unit (CPU) 310, random access memory (RAM) 320, one or more peripherals 330, a graphics controller 360, and a digital display unit 370. The CPU 310, the RAM 320 and the graphics controller 360 are typically packaged in a single unit. The single unit is referred to as a graphical source 399, and the analog display signal is generated by the unit. All components within the graphical source 399 of the computer system 300 communicate over a bus 350. The bus 350 can include several physical buses connected by appropriate interfaces.

The RAM 320 stores data representing commands and possibly pixel data representing an image. The CPU 310 executes commands stored in the RAM 320 and causes commands and pixel data to be transferred to the graphics controller 260. The peripherals 330 can include storage components such a hard-drives or removable drives (e.g. floppy-drives). The peripherals 330 can be used to store commands and data which enable the computer system 200 to operate in accordance with the present invention. By executing the stored commands, the CPU 310 provides the electrical and control signals to coordinate and control the operation of the components within the computer system 300.

The graphics controller 360 receives data and commands from the CPU, generates an analog signal and a corresponding reference signal(s), and provides both to the display unit 370. The analog signal can be generated, for example, based on pixel data received from the CPU 310 or from an external encoder (not shown). Alternatively, the graphics controller 360 can generate pixel data of an image based on commands received, for example, from the CPU 310. The graphics controller 360 then generates an analog signal based on the pixel data. In an embodiment, the analog signal is in the form of RGB signals and the reference signal(s) includes a VSYNC an HSYNC signals. However, it should be understood that the present invention can be implemented with the analog image data and reference signals in other formats and standards.

The display unit 370 receives the analog display signal from the graphics controller 360 and generates the display signals. The display signals cause an image to be generated on a display screen usually provided within the display unit 370.

The display unit 370 of the present invention receives the analog display signal and the reference signal(s). The display unit 370 digitally samples the analog display signal with an adjustably delayed sampling clock. The display unit 370 analyzes the values and characteristics of the digital samples, and automatically adjusts the delay of the sampling clock. The display unit 370 automatically optimizes the points in time that the analog display signal is digitally sampled in accordance with the present invention. The operation and implementation of the digital display unit 370 will be clear from the description below. The method of the invention will be explained and an example implementation of the digital display unit 370 presented.

THE METHOD OF THE PRESENT INVENTION

Figure 11:
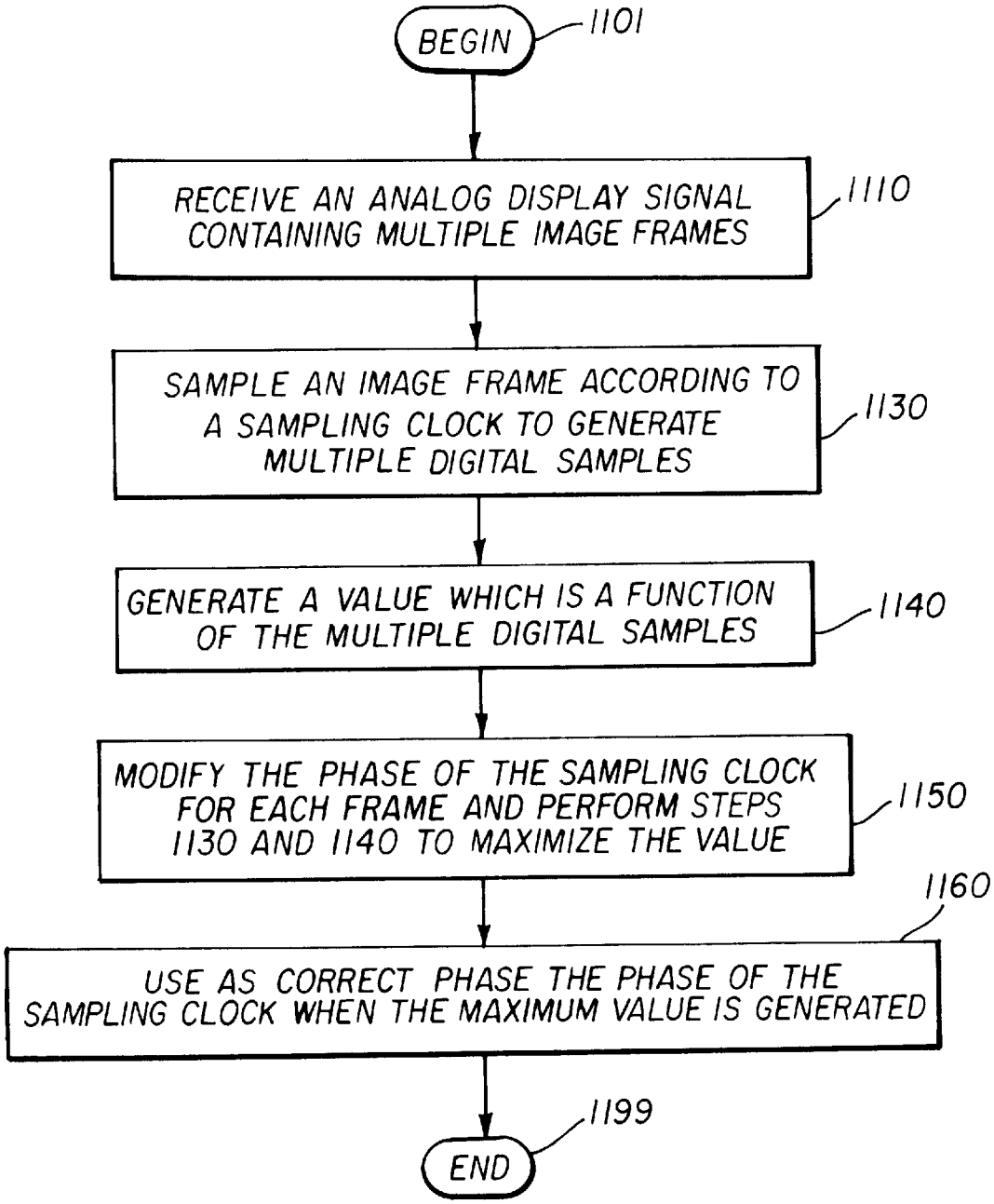
FIG. 11 is a flowchart showing overall operation of the digital display according to the present invention.

The method of the present invention is described broadly with reference to FIG. 11. In step 1110, digital display unit 370 receives an analog display signal containing multiple image frames. In step 1130, digital display unit 370 samples an image frame according to a sampling clock to generate multiple digital samples. The sampling clock generally has a phase delay control.

In step 1140, a value which is a function of the multiple digital samples is generated. Either some or all of the generated digital samples may be used for generating the value. The function can be any mathematical function, but should generally generate higher values for a correspondingly large digital sample values. In step 1150, the phase of the sampling clock is modified for each frame, and steps 1130 and 1140 are performed. The steps are performed to determine the phase which generates a maximum value for the function. The corresponding phase is determined to be the desired phase in step 1160.

The manner in which the multiple digital samples and the functions can be selected is described below with several examples.

Figure 4:
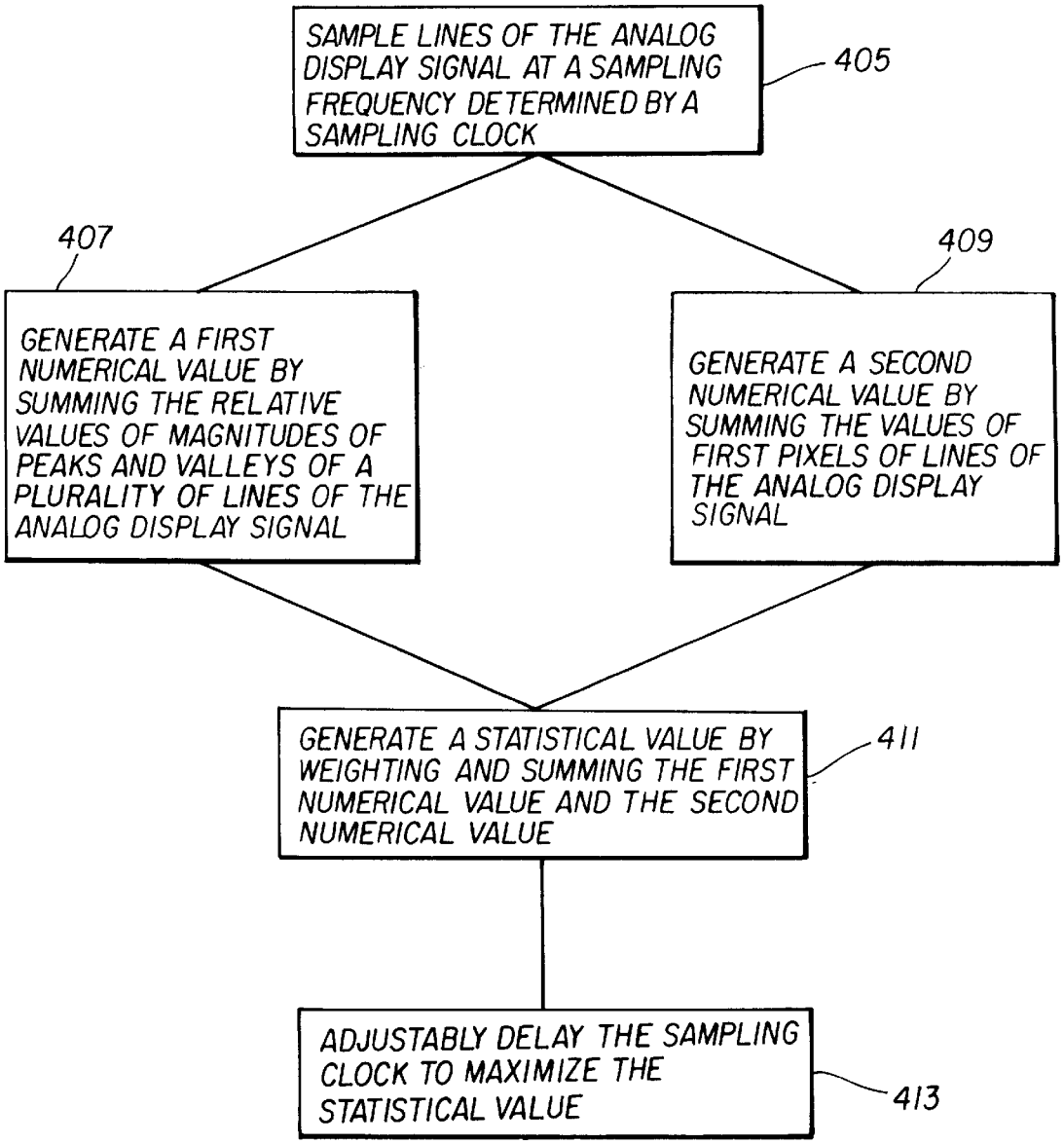
FIG. 4 is a flow chart showing the steps performed to allow automatic correction of the phase delay of the sampling signal.

FIG. 4 is a flow chart showing the steps of the method of the invention. Step 405 includes sampling the analog display signal at points in time determined by a sampling clock. Step 407 and step 409 are calculations which can occur individually or simultaneously. That is, step 407 can be included individually, step 409 can be included individually, or step 407 and step 409 can both be included. Step 411 includes generating a statistical value by weighting and summing the results of step 407 and step 409. Step 413 includes adjustably delaying the sampling clock to maximize the statistical value.

Step 407 includes generating a first numerical value by summing the relative value of the magnitudes of peaks and valleys of lines of the analog display signal. A subset of the peaks and valleys can be used. Such a subset may include only peaks, only valleys, only selected lines, etc.

A peak is detected by detecting a present digital sample of the analog display signal which has a value that is a predetermined threshold amount greater than both a prior digital sample and a subsequent digital sample. The prior digital sample is generally the digital sample taken just before the present digital sample, and the subsequent digital sample is generally the digital sample taken just after the present digital sample.

A valley is detected by detecting a present digital sample of the analog display signal which has a value that is a predetermined threshold amount less than both a prior digital sample and a subsequent digital sample. The prior digital sample is generally the digital sample taken just before the present digital sample, and subsequent digital sample is generally the digital sample taken just after the present digital sample.

The first numerical value is calculated by summing the relative values of the digital samples of the pixels which are detected as peaks and valleys. Adjusting the predetermined threshold amount will effect the number of valleys and peaks (and the corresponding values) detected. Therefore, adjusting the predetermined threshold amount will effect the value of the first numerical value.

The first numerical value can include the peaks and valleys of the digital samples of the analog display signal which occur over one or more frames of the analog display signal. The number of frames included in the calculation effects the value of the first numerical value.

Step 409 includes generating a second numerical value by summing the values of first pixels of lines of the analog display signal. A first pixel is recognizable as the first sample occurring after a horizontal sync pulse of the reference signal which exceeds a predetermined threshold.

The peak and valley detection of step 407 generally works well in optimizing the delay of the sampling clock because graphics images usually include a significant number of peaks and valleys per frame. This is especially true for business applications and graphical user interface based applications. However, is some rare cases peaks and valleys may be non-existent, infrequent or have amplitudes which are too small to reliably detect. For example, images with smooth color gradients include few peaks or valleys. To supplement the peak and valley detection of step 407, step 409 includes generating a second numerical value by summing the magnitudes of the values of the digital samples of the first pixels of lines of the image signal. The phase of the delay sampling clock is adjusted to maximize the second numerical value.

Step 411 include generating a statistical value by summing the first numerical value and the second numerical value. Step 411 can include weighting the first numerical value and weighting the second numerical value.

Step 412 include adjusting the delay of the sampling signal to maximize the statistical value. As previously mentioned, the statistical value can include either the first numerical value or the second numerical value, or a combination of both the first numerical value and the second numerical value.

AN EXAMPLE OF PEAKS AND VALLEYS

Figure 5:
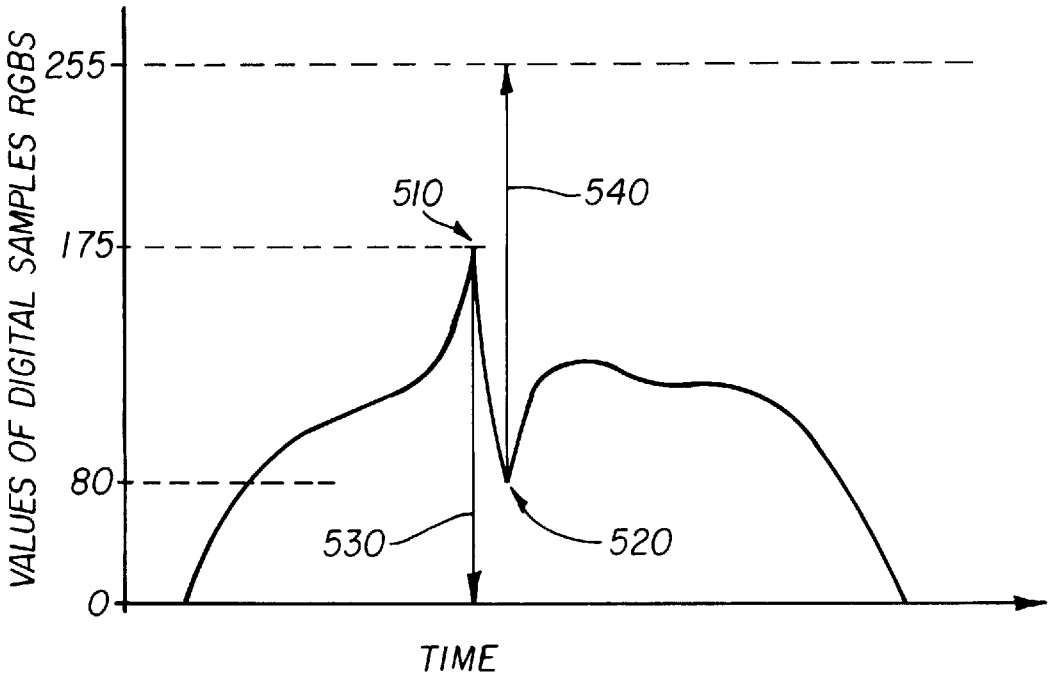
FIG. 5 is a plot of values of digital samples of an analog display signal.

FIG. 5 is a plot of values of successive digital samples of a horizontal line of an analog display signal. The digital samples include a peak 510 and a valley 520. As shown in the plot of FIG. 5, the values can range from a low value of zero to a high value of 255 (other ranges of values can be selected). An embodiment of the invention includes line 530 being the relative value of the magnitude of the digital sample which corresponds with the peak 510. As shown in FIG. 5, the relative value is about 175. Line 540 depicts the relative value of the magnitude of the digital sample which corresponds with the valley 520. As shown in FIG. 5, the relative value is about 255 minus 80 which is 175. Therefore, the sum of the relative values of the magnitudes of the peak 510 and the valley 520 is 350.

AN EXAMPLE EMBODIMENT OF THE INVENTION

Figure 6:
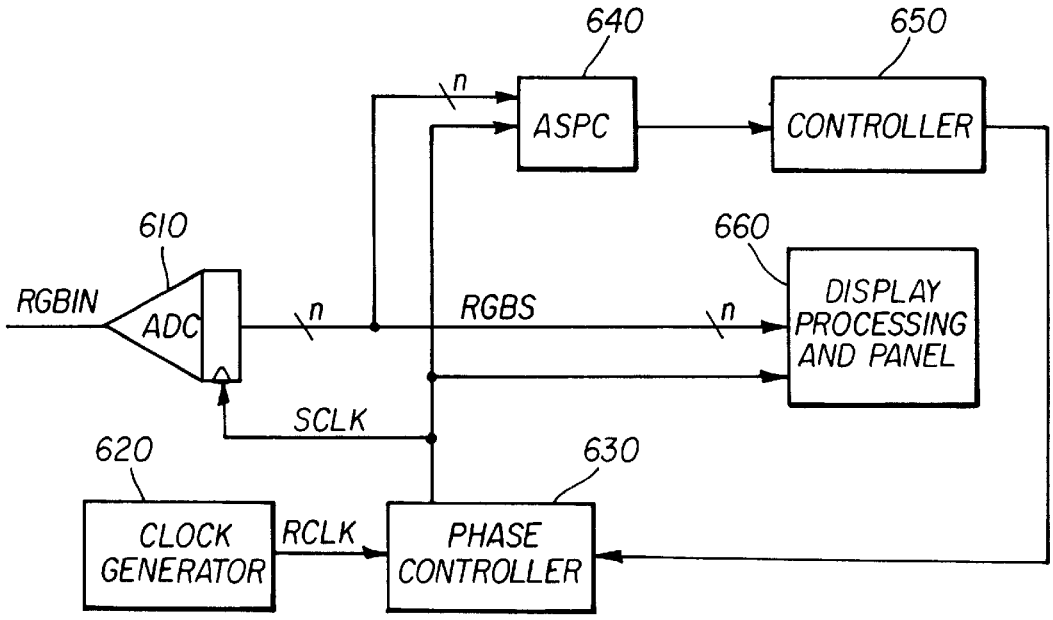
FIG. 6 shows a block diagram of an embodiment of the invention.

FIG. 6 shows a block diagram of an embodiment of the invention. This embodiment includes an ADC 610, a clock generator 620, a phase controller 630, an automatic system phase controller 640, a controller 650, and a display processing and panel 660.

The ADC 610 which receives the analog display signal. The input to the ADC 610 is designated as RGBIN. It should be noted that a separate ADC 610 generally exists for each of the red, blue and green inputs. For convenience, only a single input is shown. It should also be noted that the invention is equally applicable to analog display signal formats other than RGB.

The ADC 610 generates digital samples (designated RGBS) of the analog display signal at a rate determined by the sampling clock (SCLK). The SCLK is a time delay version of a recovered clock (RCLK). The RCLK is generated by a clock generator 620. The clock generator is generally phase locked the reference signal associated with the analog display signal.

The phase controller 630 generates the SCLK by programmably delaying the phase of the RCLK by a phase delay. The delay can be implemented in a known way. Delay can be implemented by either advancing or slowing the RCLK. The controller 650 programmably adjusts the phase delay.

The automatic system phase controller (ASPC) 640 receives the digital samples generated by the ADC 610. The ASPC 640 processes the digital samples of the analog display signal and generates a numerical value or statistical estimation for each display frame based on the characteristics of the values of the digital samples. In a first embodiment, the numerical value includes summing the magnitudes of peaks and valleys within the digital samples of the lines of the image signal. In a second embodiment, the numerical value includes summing the values of the digital samples of the first pixels of lines of the image signal. In an embodiment described below, the first and second embodiments (noted in this paragraph) are combined. The phase controller 630 is programmed so that the phase of the SCLK is adjusted to maximize the numerical values generated by the ASPC 640.

The controller 650 receives an output of the ASPC 640. The controller programmably adjusts the phase delay of the phase controller 630 according to the output of the ASPC 640. In general, the requirement is to maximize the value generated by ASPC.

The display processing and panel 660 receives the digital samples (RGBS) of the analog display signal and the SCLK. The display processing and panel 660 typically performs more synchronization and processing of the digital samples before generating a display image.

AN EXAMPLE ASPC ACCORDING TO THE INVENTION

Figure 7:
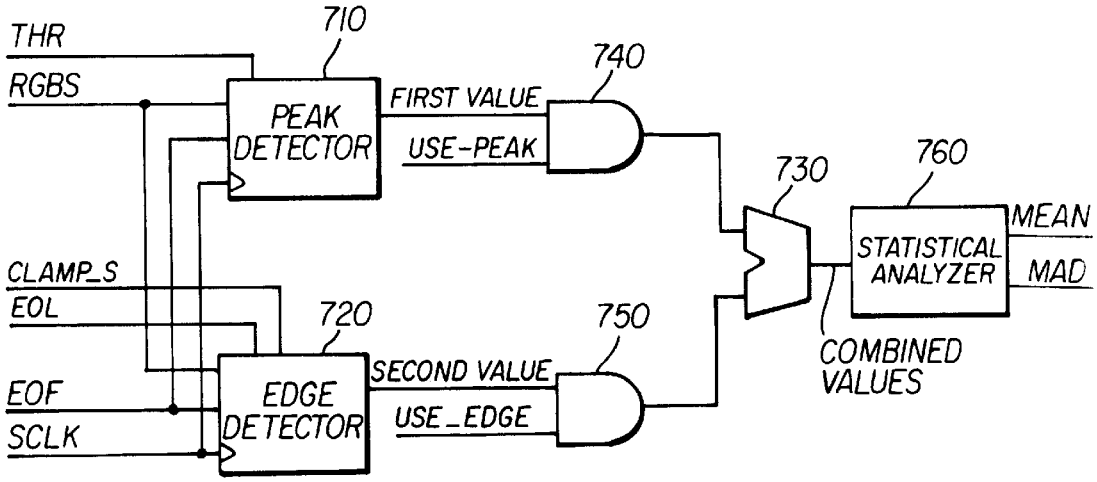
FIG. 7 shows a block diagram of an automatic sampling phase corrector according to the invention.

FIG. 7 shows a block diagram of ASPC 640 according to the invention. The ASPC includes a peak detector 710, an edge detector 720, a peak AND gate 740, an edge AND gate 750, an ASPC accumulator 730 and a statistical analyzer 760.

The peak detector 710 analyzes the digital samples and detects peaks and valleys within the digital samples of the image signal. The peak detector 710 receives a THR (peak threshold) signal which sets the minimum deviation between adjacent digital samples required before a digital sample is designated as a peak or a valley. The peak detector 710 can also sum the magnitudes of the values of the digital samples which are detected as peaks and valleys. The peak detector 710 also receives an EOF (end of frame) signal which allows the peak detector 710 to sum the magnitudes of the peaks and valley over a designated number of frame(s).

The edge detector 720 analyzes the digital samples and sums the values of the digital samples which represents the first pixel of lines of the image signal. The digital samples which represents the first pixels of lines of the image signal are identified as the first digital sample occurring after a horizontal synchronization pulse of the reference signal which exceeds a predetermined value. The edge detector 720 receives the EOL (end of line) signal as a reference point to the vertical synchronization of the image signal. The edge detector 720 receives the EOF (end of frame) signal which allows the edge detector 720 to sum the values of the digital samples which represents the first pixel of lines of the image signal over a designated number of frame(s). The edge detector 720 receives a CLAMP_S signal to aid in determination of the predetermined value as discussed later.

A peak AND gate 740 receives the output of the peak detector 710 and a control signal USE_PEAK. If the control signal USE_PEAK is high, then the numerical value generated by the peak detector 710 is used to help determine the setting of the phase controller 630. If the control signal USE_PEAK is low, then the numerical value generated by the peak detector 710 is not used to determine the setting of the phase controller 630.

An edge AND gate 750 receives the output of the edge detector 720 and a control signal USE_EDGE. If the control signal USE_EDGE is high, then the numerical value generated by the edge detector 720 is used to help determine the setting of the phase controller 630. If the control signal USE_EDGE is low, then the numerical value generated by the edge detector 720 is not used to determine the setting of the phase controller 630.

Another embodiment includes replacing the peak AND gate 740 with a peak multiplier, and replacing the edge AND gate 750 with an edge multiplier. The peak multiplier can provide the ability to scale or weight the numerical value generated by the peak detector 710 by an amount determined by a PEAK_WEIGHT control signal. The edge multiplier can provide the ability to scale or weight the numerical value generated by the edge detector 720 by an amount determined by an EDGE_WEIGHT control signal.

The ASPC accumulator 730 receives the output of the peak AND gate 740 and the output of the edge AND gate 750. The numerical value generated by the peak detector 710 and the numerical value generated by the edge detector 720 can be summed to determine the setting of the phase controller 630. A previously stated, with a peak multiplier and an edge multiplier, the numerical value generated by the peak detector 710 and the numerical value generated by the edge detector 720 can be weighted so that either one provides greater weight in the determination of the adjustment of the phase controller 630 than the other.

The ASPC 640 can also include a statistical analyzer 760. The statistical analyzer receives an output of the ASPC accumulator 730. The statistical analyzer 760 allows for analysis of the weighted numerical values generated by the peak detector 710 and the edge detector 720. The analysis can be performed on numerical values which have been generated over several frames of the display signal. The mean, standard deviation and MAD (mean absolute distance) can be calculated and used to improve the noise immunity of the sampling system.

An output of the statistical analyzer 760 can be connected to a controller which can further process the numerical values. Finally, the controller or possibly the statistical analyzer adjusts the phase controller 630 to optimize the numerical values.

AN EXAMPLE EMBODIMENT OF A PEAK DETECTOR

Figure 8:
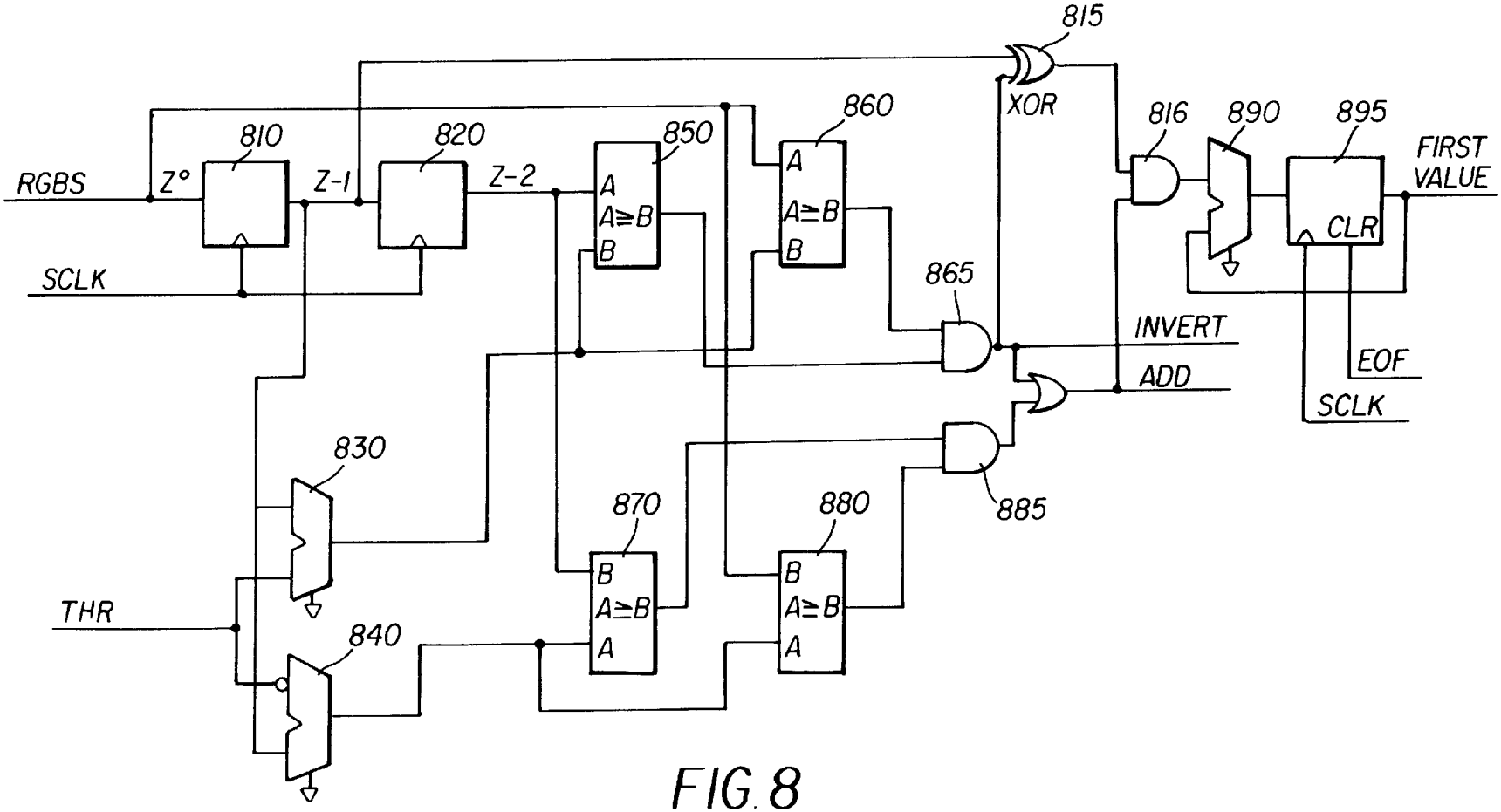
FIG. 8 shows a circuit implementation of an embodiment of a peak detector according to the invention.

FIG. 8 shows a circuit implementation of a peak detector according to the invention. A first latch 810 receives the digital samples (RGBS) generated by the ADC 610 and is clocked by the delayed sampling clock. An output of the first latch 810 is a digital sample just previous to a present digital sample. A second latch 820 receives the output of the first latch 810. An output of the second latch 820 is a digital sample twice previous to the present digital sample. The present sample can be designated as Z0, the previous sample can be designated as Z-1, and the twice previous sample can be designated and Z-2.

A first adder 830 and a second adder 840 receive the Z-1 sample and a THR (threshold) input. The THR input is a predetermined threshold value which can be generated by a system controller. The first adder 830 sums the THR input and the Z-1 sample. The second adder 840 subtracts the THR input from the Z-1 sample.

A first comparator 850 compares the output of the first adder 830 with the Z-2 sample and a second comparator 860 compares the output of the first adder 830 with the Z0 sample. If both the Z-2 sample and the Z0 sample are greater in value than the output of the first adder 830, a valley has been detected. Outputs of the first comparator 850 and the second comparator 860 are connected to a first AND gate 765. The output of the first AND gate 765 is high when a valley has been detected.

A third comparator 870 compares the output of the second adder 840 with the Z-2 sample and a fourth comparator 880 compares the output of the second adder 840 with the Z0 sample. If both the Z-2 sample and the Z0 sample are greater in value than the output of the second adder 840, a peak has been detected. Outputs of the third comparator 870 and the fourth comparator 880 are connected to a second AND gate 885. The output of the second AND gate 885 is high when a peak has been detected.

An accumulator 890 accumulates the values of the digital samples which have been identified as a peak or a valley. The accumulator receives and adds the magnitude of a presently identified peak or valley digital sample (Z-1) with a running total of the magnitudes of the peaks and valleys. The output of the accumulator 890 is latched into an accumulator latch 895. The output of the accumulator latch 895 is the first numerical value after a frame or more of lines of the analog image signal have been sampled. The accumulator latch is clocked by the delayed sampling signal, and is reset by an EOF (end of frame) signal. If more than a single frame is to be evaluated, the EOF signal can be replaced by a control signal which indicates that the desired number of frames have been sampled.

An XOR gate 815, an OR gate 786, and a third AND gate 816 determine when a digital sample is input to the accumulator 890, and ensure that the relative value of the digital sample is input to the accumulator 890. The XOR gate 815 receives the present digital sample Z-1, and the output of the first AND gate 865. As previously stated, the output of the first AND gate 865 is high when a valley has been detected. Therefore, if a valley is detected, the XOR gate 815 inverts the value of the present digital sample Z-1. Alternatively, if a valley is not detected, the XOR gate 815 does not invert the present digital sample Z-1.

The OR gate 786 receives the output of the first AND gate 865, and the output of the second AND gate 885. As previously stated, the output of the first AND gate 865 is high when a valley has been detected, and the output of the second AND gate 885 is high when a peak has been detected. Therefore, the output of the OR gate 786 is high when either a valley or a peak has been detected. A high output state of the OR gate 786 indicates that the magnitude of the present digital sample Z-1 should be added to the running total of the accumulator 890.

The third AND gate 816 receives the output of the XOR gate 815 and the output of the OR gate 786. The output of the third AND gate 816 is connected to the accumulator 890. The output of the third AND gate 816 provides the absolute magnitude of the present digital sample Z-1 to the accumulator when the present digital sample Z-1 is determined to be a peak or a valley.

AN EXAMPLE EMBODIMENT OF AN EDGE DETECTOR

Figure 9:
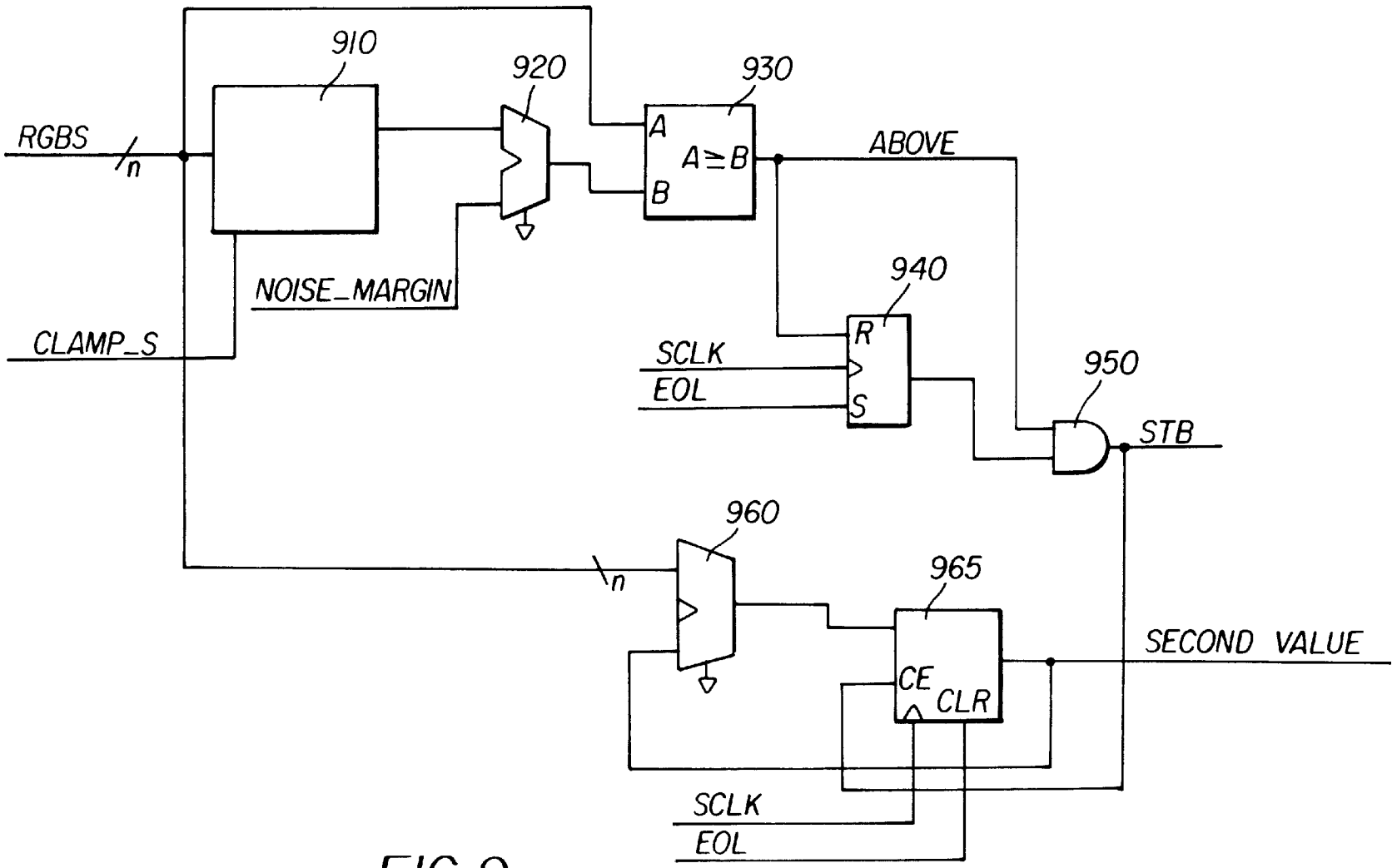
FIG. 9 shows a circuit implementation of an embodiment of an edge detector according to the invention.

FIG. 9 shows a circuit implementation of an embodiment of the edge detector 720 according to the invention. The edge detector 720 determines the value of the digital sample of the first pixel of lines of the image signal. The edge detector sums the values of the digital samples of the first pixel of the lines of the image signal. This embodiment includes summing the values of the digital samples of the first pixel of a frame of lines of the image signal. However, any desired number of frames of lines of the image signal may be included.

The edge detector 720 receives the digital samples (RGBS) of the analog image signal. The edge detector 720 includes a noise floor calibrator 910 which estimates the noise floor of the image signal. The noise floor calibrator 910 receives the CLAMP_S signal which is active when a controller determines that no pixel data is being sampled. The CLAMP_S is generally synchronized with the horizontal sync of the reference signal because the horizontal sync indicates periods of time between lines of the image signal in which no pixel information is present within the image signal. When the CLAMP_S is active, the noise floor calibrator 910 laches a noise floor digital sample. The CLAMP_S is generally active once per line of the image signal. The greater the number of noise floor samples, the greater the accuracy in the noise floor estimation of the noise floor calibrator 910.

An edge noise accumulator 920 sums the value of the estimated noise floor of the noise floor calibrator 910 with a predetermined NOISE_MARGIN input. The edge noise accumulator 920 adds the NOISE_MARGIN input to the estimated noise floor to provide a threshold digital value to compare the digital samples of the image signal for determination of which of the digital samples represent the first pixel of lines of the image signal.

A threshold comparator 930 receives the threshold digital value and the digital samples of the analog image signal. The threshold comparator 930 provides an ABOVE indicator when a digital sample exceeds the threshold digital value.

The ABOVE indicator of the threshold comparator 930 is received by an arm RS flip-flop 940 and an arm AND gate 950. The arm RS flip-flop 940 is set by the EOL (end of line) signal, and therefore, ready to be reset by the ABOVE indicator. The arm AND gate 950 also receives an ARMED output of the arm RS flip-flop 940. The arm RS flip-flop 940 is clocked by the delayed sampling clock. The ARMED output of the arm RS flip-flop 940 remains high until one cycle of the delayed sampling clock after the ABOVE indicator goes high. As previously stated, the arm RS flip-flop 940 is set by the EOL signal. Therefore, the arm AND gate 950 outputs an STB pulse once per line of the image signal if a data sample of the image signal exceeds the threshold digital value. The operation of the edge detector 720 is similar to the operation of a digital oscilloscope time base trigger. The triggering level (threshold digital value) is set above the noise floor (estimated noise floor) with some margin (NOISE_MARGIN). The first occurrence of the input above the trigger level triggers the time base and data is captured.

A pixel value accumulator 960 adds the digital samples values of lines of the image signal to an output of an edge_score register 965. An output of the pixel value accumulator 960 is connected to an input of the edge_score register 965. The STB pulse drives a CE (clock enable) input of the edge_score register 965. When the CE input of the edge_score register 965 is high, the edge_score register 965 laches the output of the pixel value accumulator 960 which represents a running sum of the digital values of the first pixels of the lines of the image signal. The edge_score register 965 of this embodiment is cleared by the EOF (end of frame) signal. Therefore, this embodiment of the edge detector 720 sums the digital values of the first pixel of the lines of a frame of the image signal.

AN EXAMPLE EMBODIMENT OF A STATISTICAL ANALYZER

Figure 10:
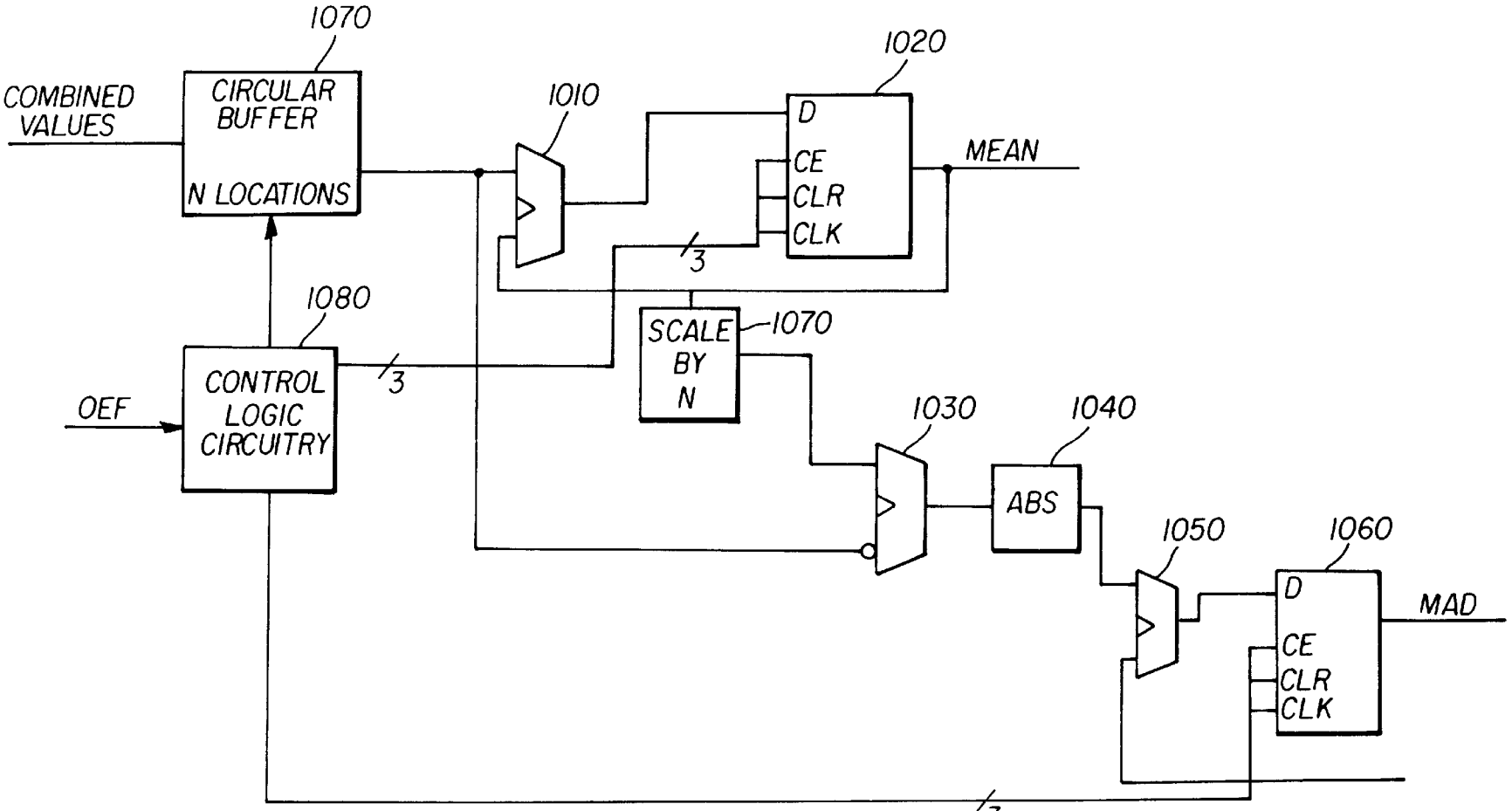
FIG. 10 shows a circuit implementation of an embodiment of a statistical analyzer according to the invention.

FIG. 10 shows a circuit implementation of an embodiment of the statistical analyzer 760 according to the invention. As stated previously, the statistical analyzer 760 receives an output of the ASPC accumulator 730. The statistical analyzer 760 allows for analysis of weighted numerical values generated by the peak detector 710 and the edge detector 720. The analysis can be performed on numerical values which have been generated over several frames of the display signal. The mean, standard deviation and MAD (mean absolute distance) can be calculated and used to improve the noise immunity of the sampling system.

The statistical analyzer 760 includes a circular buffer 1070 which includes N memory locations. The combined values of the peak detector 710 and the edge detector 720 are stored in the circular buffer 1070. More specifically, the last N combined values are stored in the circular buffer 1070. The number N defines a sampling window of the statistical analyzer 760. N is generally selected to be a power of 2 for ease of implementation of the statistical analyzer 760. A first output of the statistical analyzer 760 is a MEAN of the last N number of combined values. The MEAN is defined as the summation of the last N combined values, and is generated by the combination of a mean accumulator 1010 and a mean latch 1020. The mean accumulator 1010 receives combined values from the circular buffer 1070 as defined by a statistical logic controller 1080, and also receives an output from the mean latch 1020. The MEAN is generated at the output of the mean latch 1020. CE (clock enable) and CLR (clear) inputs to the mean latch 1020 are controlled by the statistical logic controller 1080.

The statistical analyzer 760 also generates a MAD (mean absolute distance) of the combined values of the peak detector 710 and the edge detector 720. The MAD is defined as;

$$MAD=\Sigma|[(MEAN/N)-Xi]|$$

where Xi are the combined values within the circular buffer, and N is the size of the circular buffer.

If the MAD is high, then the display signal is changing greatly from frame to frame. This condition can suggest eliminating either the peak detector 710 output or the edge detector 720 output from the determination of the setting of the delay through the phase controller 630.

Circuit implementation of the calculation of the MAD merely follows the equation above. The MEAN is scaled by N through an N scaler 1070. A MAD adder 1030 generates the difference between MEAN/N and the combined values Xi. An absolute value circuit 1040 generates an absolute value of an output of the MAD adder 1030. Finally, a MAD accumulator 1050 and a MAD latch 1060 generate a summation of an output of the absolute value circuit 1040. An output of the MAD latch 1060 generates the MAD. Circuit implementations of the N scaler 1070 and the absolute value circuit 1040 are known in the art of digital electronics. CE (clock enable) and CLR (clear) inputs to the MAD latch 1060 are controlled by the statistical logic controller 1080.

CONCLUSION

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A method of optimizing the points in time that an analog display signal is sampled, said method comprising the steps of:

(a) receiving said analog display signal, wherein said analog display signal contains a plurality of image frames;

(b) generating a sampling clock delayed by a phase;

(c) sampling a plurality of lines in an image frame at points in time determined by said sampling clock to generate a plurality of display signal digital samples;

(d) generating a value which is a function of said display signal digital samples; and (e) modifying said phase for successive image frames and performing steps (b)–(d) to maximize said value, wherein step (e) comprises:

(j) detecting peaks and/or valleys of a signal representing said display signal digital samples;

(k) generating a first numerical value based upon relative values of magnitudes of the peaks and/or valleys; and (l) adjusting the delay of the sampling clock maximizing the first numerical value, wherein said phase corresponding to said maximum value represents optimal points in time to sample said analog display signal.

2. The method of claim 1, further comprising the steps of:

(f) determining whether said successive image frames encoded in said analog display signal are changing substantially; and (g) disabling said method of optimizing if said successive image frames encoded in said analog display signal are changing substantially.

3. The method of claim 1, wherein step (e) comprises the further step of:

(h) generating a second numerical value based on values of first pixels of lines of the display signal digital samples; and (i) adjusting said phase of the sampling clock maximizing the second numerical value.

4. The method of claim 1, wherein step (e) comprises the further step of:

(m) generating a second numerical value based on values of first pixels of lines of the display signal digital samples; and (n) adjusting the delay of the sampling clock maximizing the second numerical value.

5. The method of claim 4, further comprising the steps of:

(o) summing a weighted representation of the first numerical value and a weighted representation of the second numerical value generating a statistical value; and (p) adjusting the delay of the sampling clock maximizing the statistical value.

6. The method of claim 5, wherein step (k) comprises the step of generating said first numerical value by summing the relative values of the magnitudes of the peaks and/or valleys of the display signal digital samples.

7. The method of claim 1, further comprising the step of generating said first numerical value based upon the peaks and/or valleys of at least one frame of display signal digital samples.

8. The method of claim 1, wherein detecting a valley comprises identifying a display signal digital sample having a value a predetermined valley threshold less than a prior display signal digital sample and a value a predetermined valley threshold less than a subsequent display signal digital sample.

9. The method of claim 1, wherein detecting a peak comprises identifying display signal digital sample having a value a predetermined peak threshold greater than a prior display signal digital sample and having a value a predetermined peak threshold greater than a subsequent display signal digital sample.

10. The method of claim 3, wherein generating a second numerical value comprises the step of:

(q) summing the values of the display signal digital samples which are identified as first pixels of lines of the display signal digital samples.

11. The method of claim 10, wherein step (q) comprises the steps of:

(r) identifying display signal digital samples occurring immediately after a horizontal synchronization signal pulse which have a value greater than a predetermined edge threshold; and (s) summing the values of the identified display signal digital samples.

12. The method of claim 8, wherein step (r) comprises the step of:

(t) determining a predetermined edge threshold by identifying a display signal digital sample which occurs during the horizontal synchronization pulse;

(u) setting the predetermined edge threshold equal to value of the identified display signal digital sample.

13. A clock generation circuit comprising:

means for receiving said analog display signal, wherein said analog display signal contains a plurality of image frames;

means for generating a sampling clock delayed by a phase;

means for sampling a plurality of lines in an image frame at points in time determined by said sampling clock to generate a plurality of display signal digital samples;

means for detecting peaks and valleys within each line of the analog display signal from the ADC samples and generates a value based on the magnitudes of the peaks and/or valleys, wherein said first numerical value can be provided as said value; and means for modifying said phase for successive image frames to maximize said value, wherein said phase corresponding to said maximum value represents optimal points in time to sample said analog display signal.

14. An automatic sampling control system comprising:

a clock generator for generating a sampling clock;

a phase controller for modifying the phase of said sampling clock by a phase amount;

an analog to digital converter (ADC) for sampling an image frame contained in an analog display signal to generate a plurality of display signal digital samples, said ADC sampling the analog display signal at points in time determined by said phase amount;

a automatic system phase controller (ASPC) detecting peaks and/or valleys within each line of the analog display signal from the ADC samples and generates a first numerical value based on the magnitudes of the peaks and valleys, wherein said first numerical value can be provided as said value; and a controller for receiving said first numerical value and modifying said phase amount for each of a plurality of successive image frames contained in said analog display signal, wherein said controller modifies said phase amount to cause said ASPC to generate a maximum value, wherein said phase amount represents the optimal phase change for the sampling clock generated by said clock generator.

15. The automatic sampling control system of claim 14, wherein said ASPC comprises a peak detector which detects peaks and/or valleys within each line of the analog display signal from the ADC samples and generates said first numerical value based on magnitudes of the peaks and/or valleys.

16. The automatic sampling control system of claim 15, wherein the sampling phase controller further comprises an edge detector which generates a second numerical value based on sampling values of first pixels of lines of the analog display signal, the statistical controller adjusting the phase controller maximizing the second numerical value.

17. The automatic sampling control system of claim 16, wherein the sampling phase controller further comprises a statistical analyzer which combines the first numerical value and the second numerical value generating said value.

18. The automatic sampling control system of claim 17, wherein the statistical analyzer weights the effect of the first numerical value and the effect of the second numerical value on the statistical value.

19. The automatic sampling control system of claim 15, wherein the peak detector only detects peaks and/or valleys which have an amplitude greater than a predetermined threshold.

20. The automatic sampling control system of claim 15, wherein relative values of the magnitudes of the peaks and/or valleys are summed to generate the first numerical value.

21. The automatic sampling control system of claim 20, wherein the first numerical value is calculated based on at least one frame of analog display signal lines.

22. The automatic sampling control system of claim 16, wherein the second numerical value is determined by summing the values of the digital samples occurring immediately after horizontal synchronization pulses which have amplitudes greater than a predetermined edge threshold.

23. The automatic sampling control system of claim 14, wherein said controller does not modify said phase if said successive image frames encoded in said analog display signal are changing substantially.

24. A display unit comprising:

a clock generator for generating a sampling clock;

a phase controller for modifying the phase of said sampling clock by a phase amount;

an analog to digital converter (ADC) for sampling an image frame contained in an analog display signal to generate a plurality of display signal digital samples, said ADC sampling the analog display signal at points in time determined by said phase amount;

a sampling phase controller detecting peaks and/or valleys within each line of the analog display signal from the ADC samples and generates a first numerical value based on the magnitudes of the peaks and/or valleys, wherein said first numerical value can be provided as said value; and a controller for receiving said first numerical value and modifying said phase amount for each of a plurality of successive image frames contained in said analog display signal, wherein said controller modifies said phase amount to cause said sampling phase controller to generate a maximum value, wherein said phase amount represents the optimal phase change for the sampling clock generated by said clock generator.

25. The display unit of claim 24, wherein said sampling phase controller comprises a peak detector which detects peaks and/or valleys within each line of the analog display signal from the ADC samples and generates said first numerical value based on the magnitudes of the peaks and/or valleys.

26. The display unit of claim 25, wherein the sampling phase controller further comprises an edge detector which generates a second numerical value based on sampling values of first pixels of lines of the analog display signal, the statistical controller adjusting the phase controller maximizing the second numerical value.

27. The display unit of claim 26, wherein the sampling phase controller further comprises a statistical analyzer which combines the first numerical value and the second numerical value generating said value.

28. The display unit of claim 24, wherein said controller does not modify said phase if said successive image frames encoded in said analog display signal are changing substantially.

29. A method of optimizing the points in time that an analog display signal is sampled, said method comprising the steps of:

(a) receiving said analog display signal, wherein said analog display signal contains a plurality of image frames;

(b) generating a sampling clock delayed by a phase;

(c) sampling a plurality of lines in an image frame at points in time determined by said sampling clock to generate a plurality of display signal digital samples;

(d) generating a value which is a function of said display signal digital samples; and (e) modifying said phase for successive image frames and performing steps (b)–(d) to maximize said value, wherein said phase corresponding to said maximum value represents optimal points in time to sample said analog display signal;

(f) determining whether said successive image frames encoded in said analog display signal are changing substantially; and (g) disabling steps (b)–(e) if said successive image frames encoded in said analog display signal are changing substantially.

30. A display unit optimizing the points in time that an analog display signal is sampled, said display unit comprising:

means for receiving said analog display signal, wherein said analog display signal contains a plurality of image frames;

means for generating a sampling clock delayed by a phase;

means for sampling a plurality of lines in an image frame at points in time determined by said sampling clock to generate a plurality of display signal digital samples;

means for generating a value which is a function of said display signal digital samples;

means for modifying said phase for successive image frames to maximize said value, wherein said phase corresponding to said maximum value represents optimal points in time to sample said analog display signal;

means for determining whether said successive image frames encoded in said analog display signal are changing substantially; and means for disabling said means for modifying if said successive image frames encoded in said analog display signal are changing substantially.

31. An automatic sampling control circuit comprising:

a clock generator for generating a sampling clock;

a phase controller for modifying the phase of said sampling clock by a phase amount;

an analog to digital converter (ADC) for sampling an image frame contained in an analog display signal to generate a plurality of display signal digital samples, said ADC sampling the analog display signal at points in time determined by said phase amount;

an automatic system phase controller (ASPC) for generating a value as a function of said display signal digital samples; and a controller for receiving said value and modifying said phase amount for each of a plurality of successive image frames contained in said analog display signal, said controller modifying said phase amount to cause said ASPC to generate a maximum value, said controller not modifying said phase amount if successive image frames are substantially different.

* * * * *